US005275901A

United States Patent [19]

Anno et al.

[11] Patent Number: 5,275,901

[45] Date of Patent: Jan. 4, 1994

[54] DEVELOPER FOR ELECTROPHOTOGRAPHY

[75] Inventors: Masahiro Anno, Sakai; Eiichi Sano, Takatsuki; Makoto Kobayashi, Settsu; Junji Machida, Toyonaka, all of Japan

[73] Assignee: Minolta Camera Kabushiki Kaisha, Osaka, Japan

[21] Appl. No.: 876,442

[22] Filed: Apr. 30, 1992

[30] Foreign Application Priority Data

May 10, 1991 [JP] Japan ..... 3-135757

[51] Int. Cl.[5] ..... G03G 9/08; G03G 9/083

[52] U.S. Cl. ..... 430/106.6; 430/110; 430/111

[58] Field of Search ..... 430/106.6, 110

[56] References Cited

U.S. PATENT DOCUMENTS

| | | | |
|---|---|---|---|
| 3,840,464 | 10/1974 | Van Engeland et al. | 430/108 |
| 4,395,485 | 7/1983 | Kashiwagi et al. | 430/106.6 |
| 4,835,082 | 5/1989 | Koishi et al. | 430/109 |
| 5,035,305 | 10/1991 | Aoki et al. | 430/106.6 |
| 5,124,222 | 6/1992 | Clark et al. | 430/110 |

FOREIGN PATENT DOCUMENTS

| | | | |
|---|---|---|---|
| 53-102040 | 2/1977 | Japan . | |
| 58-118652 | 1/1982 | Japan . | |
| 59-37553 | 8/1982 | Japan . | |
| 158338 | 7/1986 | Japan | 430/106.6 |
| 1-51878 | 6/1990 | Japan | 430/106.6 |

*Primary Examiner*—Roland Martin

*Attorney, Agent, or Firm*—Burns, Doane, Swecker & Mathis

[57] ABSTRACT

The present invention relates to a developer for developing electrostatic latent images obtained by mixing toner particles comprising a binder resin and a coloring agent with fine magnetic particles treated by hydrophobic agent.

13 Claims, No Drawings

DEVELOPER FOR ELECTROPHOTOGRAPHY

BACKGROUND OF THE INVENTION

1. Field of the Invention

The present invention relates to monocomponent and two-component type developer for electrophotography to be used in electrophotographic copying apparatus and printers.

2. Description of the Related Art

Images are produced by electrophotographic copying apparatus and printers by first charging the surface of an electrostatic latent image bearing member, e.g., photosensitive member, with a uniform electric charge, exposing said surface to an exposure light pattern corresponding to the image of an original document, or writing on said surface with light having an output content, so as to thereby form an electrostatic latent image on said surface of the photosensitive member. The surface of the photosensitive member having the aforesaid electrostatic latent image is developed (rendered visible) by a developing device, and the developed toner image is then transferred onto a transfer medium.

The aforesaid developing device uses a monocomponent developing material comprising only a toner, or a two-component developing material comprising a toner and a magnetic carrier to develop the electrostatic latent image formed on the surface of the photosensitive member by uniformly contacting the surface of said photosensitive member. The toner in the aforesaid developing material normally comprises thermoset resin, coloring material, charge-controlling agent, and fluidizing agent and the like. The aforementioned two-component developing material comprises a toner and a magnetic carrier such as ferrite and the like.

Electrophotographic processes using the aforesaid developing materials have in recent years come to require high quality image production. A high degree of uniformity in the density of the solid portion of images is demanded in forming high quality images, such that excellent fluidity is required of the developing material and particularly the toner. Furthermore, improvement of image quality such as in image resolution, tone, or line reproducibility requires toner particles of very small particle diameter. However, as toner particle size becomes smaller, there is a corresponding reduction in toner fluidity which adversely affects developing material transportability, mixing characteristics and the like.

In order to eliminate the aforesaid disadvantages and improve fluidity, blocking resistance and the like, fluidizing agents are added. Fluidizing agents added to the toner use fine particles such as, for example, colloidal silica, titanium oxide, alumina and the like having a mean particle diameter of 10~30 nm. The necessity of adding the aforesaid fine particle becomes greater in correlation with the smaller particle diameter of the toner and carrier. However, when a large amount of a fluidizing agent is used, said fluidizing agent is dispersed to the developing apparatus during developing so as to cause toner fogging and soiling of the interior of the image forming apparatus. Furthermore, when a nonmagnetic toner is used, dispersion of the toner itself outside the developing apparatus becomes prevalent.

SUMMARY OF THE INVENTION

A main object of the present invention is to provide an electrophotographic developing material having excellent fluidity and capable of producing high quality images without dispersion of the toner and fine particles.

A further object of the present invention is to provide an electrophotographic developing material having excellent environmental stability, minimal electric charge reduction under conditions of high temperature and high humidity, and minimal electrical charge elevation under conditions of low temperature and low humidity.

A still further object of the present invention is to provide an electrophotographic developing material having a high degree of freedom in electrical physical properties such as electrical resistance and the like.

The aforesaid objects of the invention are accomplished by providing a developing material to which hydrophobic-processed fine magnetic particles with a mean particle diameter of 100 nm or less have been added.

DETAILED DESCRIPTION OF THE PREFERRED EMBODIMENTS

In formulating the magnetic fine particles in the developing material, magnetic fine particles are added to the toner particles, and mixed by a Henschel mixer or the like so as to electrostatically adhere the magnetic fine particles to the surface of the toner particles.

The magnetic fine particles used in the developing material of the present invention have a mean particle diameter of 100 nm or less, preferably a mean particle diameter of 80 nm or less, and ideally a mean particle diameter of 50 nm or less. If the mean particle diameter of the magnetic fine particles exceeds 100 nm, fluidity is not effectively improved, whereas if the mean particle diameter of the magnetic fine particles is less than 80 nm, the effectiveness of the improvement of the developing material fluidity is enhanced, and particle adherence to the toner is strengthened with the effect that toner dispersion is prevented.

If the mean particle diameter of the magnetic fine particles exceeds 100 nm, the fluidity modification is not only ineffective, the magnetic fine particles have difficulty attaching to the surface of the toner particles and behave individually during the developing process. Even when the magnetic fine particles do adhere to the toner particles, said adherence is not uniform which markedly reduces effectiveness in preventing dispersion. Thus, developing material fluidity are improved, as are handling characteristics, mixing characteristics, image quality, and blocking resistance, by blending fine particles of predetermined diameter in the developing material. Furthermore, the fine particles are pulled to the magnetic sleeve via a small magnetic force because said fine particles are magnetic in character, such that dispersion of the toner supporting said fine particles is suppressed on a large scale.

The magnetic fine particles used in the developing material of the present invention are pretreated by a hydrophobic process, and impart a high degree of environmental stability to the developing material. That is, minimal electric charge reduction occurs under conditions of high temperature and high humidity, and minimal electrical charge elevation occurs under conditions of low temperature and low humidity, thereby enhancing the improvement of the fluidity. Furthermore, there is an extremely high degree of freedom in electrical physical properties such as electrical resistance and the like, and said properties can be adjusted in accordance with the characteristics of the developing material used. The extent of the hydrophobic nature of the magnetic fine particles is preferably 30% or more.

The degree of hydrophobicity was measured in the following manner. Fifty milliliters of demineralized water was poured into a beaker of 200 ml capacity, and 0.2 g of magnetic fine particles were added. As the suspension was mixed, methanol dehydrated with anhydrous sodium sulfate was slowly added from a buret, and the point at which the magnetic fine particles were not observed on the surface of the fluid was designated the end point. The degree of hydrophobicity was calculated, via the equation below, from the amount of methanol required to reach the aforesaid end point.

$$\text{Degree of hydrophobicity (\%)} = C/(50+C)\times 100$$

(where C expresses the amount (ml) of methanol used.)

The hydrophobic agent used in the hydrophobic process of the aforesaid magnetic fine particles may be various types of coupling agents such as, for example, silane, titanate, aluminum, zirco-aluminum, and the like. Coupling agents containing fluorine, and coupling agents containing nitrogen compounds may also be used to improve electric charging characteristics. Furthermore, various combinations of coupling agents may be used in the aforesaid process.

Examples of useful silane coupling agents are fluorosilane, alkyl silane, alkoxysilane, silazane and the like. More specific examples of useful agents are $(CH_3)_2SiCl_2$, $(CH_3)_3SiCl$, $CH_3Si(OCH_3)_3$, $CH_3Si(OCH_2CH_3)_3$, $(CH_3)_3Si(OCH_3)$, $(CH_3)_2Si(OCH)_3)_2$, $(CH_3)_2Si(OCH_2CH_3)_2$, $Si(OCH_2CH_3)_4$, $Si(OCH_3)_4$, $CH_3(H)Si(OCH_3)_2$, $CH_3(H)Si(OCH_2CH_3)_2$, $(CH_3)_2(H)Si(OCH_2CH_3)$, $(C_6H_5)_2Si(OCH_3)_2$ (where $(C_6H_5)$ is a phenyl group here and hereinafter), $(C_6H_5)_2Si(OCH_2CH_3)_3$, $(C_6H_5)_2Si(OCH_2CH_3)_2$, $(C_6H_5)Si(OCH_3)_3$, $(C_6H_5)_2SiCl_2$, $(C_6H_5)_2CH_3SiCl$, $(C_6H_5)SiCl_3$, $(C_6H_5)(CH_3)SiCl_2$, $(CH_3)_3SiNHSi(CH_3)_3$, $CH_3(CH_2)_{17}Si(CH_3)(OCH_3)_2$, $CH_3(CH_2)_{17}Si(OCH_3)_3$, $CH_3(CH_2)_{17}Si(OCH_2H_5)_3$, $CH_3(CH_2)_3Si(CH_3)_2ClCH_3(CH_2)_{17}SiCl_3$ and the like.

Examples of useful titanate coupling agents are listed below.

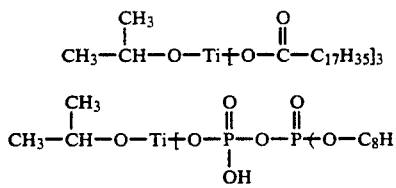

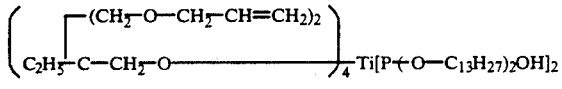

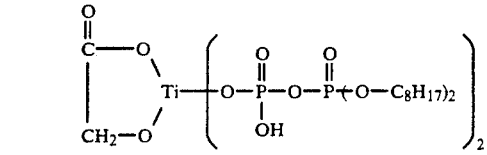

-continued

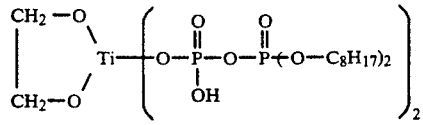

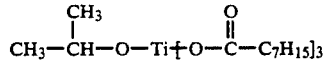

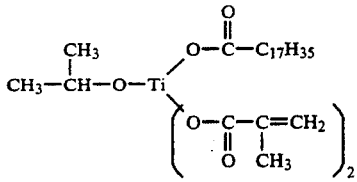

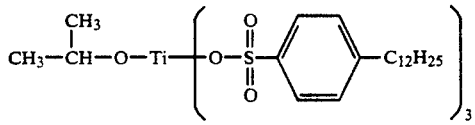

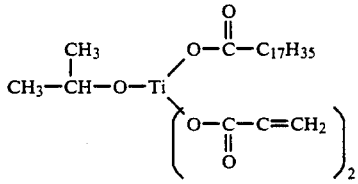

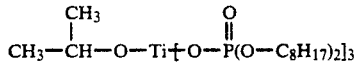

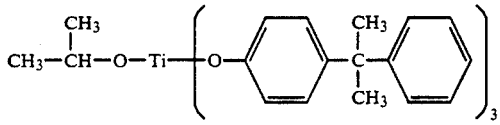

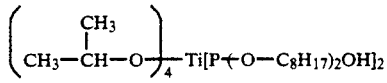

Examples of useful coupling agents containing fluorine are $CH_3(CH_2)SiCl_3$, $CF_3(CF_2)_5SiCl_3$, $CF_3(CF_2)_5(CH_2)_2SiCl_3$, $CF_3(CF_2)_5(CH_2)_2SiCl_3$, $CF_3(CF_2)_7(CH_2)_2SiCl_3$, $CF_3(CF_2)_7CH_2CH_2Si(OCH_3)_3CF_3(CF_2)_7(CH_2)_2Si(CH_3)Cl_3$, $CF_3(CH_2)_2Si(OCH_3)_3$, $CF_3(CH_2)_2Si(CH_3)(OCH_3)_2$, $CF_3(CF_2)_3(CH_2)_2Si(OCH_3)_3$, $CF_3(CF_2)_5(CH_2)_2Si(OCH_3)_3$, $CF_3(CF_2)_6CONH(CH_2)_2Si(OC_2H_5)_3$, $CF_3(CF_2)_6COO(H_2)_2Si(OCH_3)_3$, $CF_3(CF_2)_7(CH_2)_2Si(OCH_3)_3$, $CF_3(CF_2)_7(CH_2)_2Si(CH_3)(OCH_3)_2$, $CF_3(CF_2)_7SO_2NH(CH_2)_3Si(OC_2H_5)_3$, $CF_3(CF_2)_8(CH_2)Si(OCH_3)_3$ and the like.

Examples of useful coupling agents containing nitrogen compounds are $CH_3CH_2(NH_2)CH_2NH(CH_2)Si(OCH_3)_3H_2N(CH_2)_3Si(OC_2H_5)_3$, $H_2N(CH_2)_2NH(CH_2)_3Si(OCH_3)_3$, $H_2N(CH_2)_2NH(CH_2)_3Si(CH_3)(OCH_3)_2$, $H_2N(CH_2)NH(CH_2)_3Si(OCH_3)_3$, $H_2N(CH_2)_2NH(CH_2)_2NH(CH_2)_3Si(OCH_3)_3$, $H_2N(CH_2)_3Si(OCH_3)_3$, $C_6H_5NH(CH_2)_3Si(OCH_3)_3$, $H_2N(C_6H_4)Si(OCH_3)_3$ (where $(C_6H_4)$ is a phenyl group here and hereinafter), $H_2NCH_2CH_2NHCH_2(C_6H_4)CH_2CH_2Si(OCH_3)_3$, $H_2NCH_2(C_6H_4)CH_2CH_2Si(OCH_3)_3$, $(C_5H_4N)CH_2CH_2Cl_3$ (where $C_5H_4N$ is a pyridine group) and the like.

In the hydrophobic process, the type of coupling agent, amount used, and other reaction conditions may be modified as necessary. The aforesaid coupling agents may be used individually, or used in combination of two or more types thereof. Furthermore, the aforesaid process may be performed two or more times.

Using a coupling agent as described above which has a long chain alkyl group is extremely effective in improving the hydrophobic property of the magnetic fine particles.

Various well known methods may be used in the hydrophobic processing of the magnetic fine particles using coupling agents. For example, in a dry process, the coupling agent may first be diluted using a solvent such as tetrahydrofuran (THF), toluene, ethyl acetate, methyl ethyl ketone and the like. The magnetic fine particles are forcibly mixed by a blender or the like, the aforesaid coupling agent diluent is added by drops, spray or the like until adequately mixed. Then, the mixture is moved to a vat or the like, and heated in an oven to dry. Thereafter, the mixture is again mixed and stirred a blender until adequately ground. The coupling agents may be used simultaneously in the same process, or in separate processes.

Alternatively, a wet process may be used. That is, the magnetic fine particles are immersed in an organic solvent containing the coupling agent, then, dried, or the magnetic fine particles may be dispersed underwater so as to form a slurry-like solution, which is then drips into an aqueous solution of the coupling agent, and thereafter the magnetic fine particles are settled out, dried by heating, and ground.

Magnetic Fine Particles

The aforesaid magnetic fine particle materials are not specifically limited inasmuch as various well known materials may be used. For example, when producing a black toner, magnetite which is itself black in color is used with a coloring agent. When producing a color toner, a metallic iron or the like having slight black wash material is used. Representative magnetic materials or magnetizable materials are, for example, metals having strong magnetic properties such as cobalt, iron, nickel and the like, metallic alloys such as aluminum, cobalt, iron, lead, magnesium, nickel, zinc, antimony, beryllium, bismuth, cadmium, calcium, manganese, selenium, titanium, tungsten, vanadium and the like, or compounds thereof, as well as oxides, sintered materials (ferrites) and other fine particles.

The magnetic fine particles used in the present invention preferably has a smallest diameter/a largest diameter ratio X such that $X \geqq 0.7$. Furthermore, it is desirable that the insularity of the magnetic fine particles be an electrical resistance of $10^6$ Ωcm or more, and preferably $10^8 \sim 10^{13}$ Ωcm. The fine particles may be manufactured by a vapor phase method or the like.

The amount of the magnetic fine particles used is 0.05 to 3 parts-by-weight (pbw), and preferably 0.1 to 1 pbw. When normally using an added fluidizing agent, the amount of magnetic fine particles is 0.05 to 2 pbw, and preferably 0.1 to 1 pbw.

The other constituents used in the developing material of the present invention such as binder resins, coloring agents, electrical charge-regulating agents and the like may all be well known conventional toner components.

Binder Resin

The binder resin used in the developing material of the present invention is not specifically limited inasmuch as a general purpose binder resin is used in the toner and developing material. For example, usable binder resins are thermoplastic resins such as polystyrene resin, poly(meth)acrylic resin, polyolefin resin, polyamide resin, polycarbonate resin, polyether resin, polysulfone resin, polyester resin, epoxy resin and the like, or thermosetting resins such as urea resin, urethane resin, urea resin, epoxy resin and the like, as well as copolymers, block copolymers, graft copolymers and polymer blends thereof.

The toner used in the high-speed copying apparatus popularized in recent years must quickly adhere to the transfer sheet and have high separability from the fixing roller. Desirable binder resins for use in the aforesaid high-speed copying apparatus are homopolymers or copolymers synthesized from styrene monomers, (meth)acrylic monomers, (meth)acrylate monomers, or polyester resin.

The molecular weight of the aforementioned binder resins is such that the relationships among the number-average molecular weight (Mn), weight-average molecular weight (Mw), and Z-average molecular weight (Mz) are $1{,}000 \leqq Mn \leqq 7{,}000$, $40 \leqq Mw/Mn \leqq 70$, $200 \leqq Mz/Mn \leqq 500$, with $2{,}000 \leqq Mn \leqq 7{,}000$ being preferable. Furthermore, oilless fixing toner preferably has a glass transition temperature of 55°~80° C., softening point of 80°~150° C., and contains gelation components at a rate of 5~20 % by weight.

Translucent color toner may be provided with vinyl chloride resistance and translucence as a translucent toner, preferably via a polyester resin to maintain adhesion to OHP sheets. When the aforesaid polyester resin is used in a translucent toner, it is preferably a linear polyester having a glass transition temperature of 55°~70° C., a softening point of 80°~150° C., number-average molecular weight (Mn) of 2,000 to 15,000, and a molecular weight distribution (Mw/Mn) of 3 or less.

A linear urethane-modified polyester produced by reacting di-isocyanate with a linear polyester resin may be used as a translucent color toner resin. The aforesaid linear urethane-modified polyester is a linear urethane-modified polyester resin produced by the reaction of 0.3~0.95 mole of di-isocyanate with 1 mole of a linear polyester resin which consists of a dicarboxylic acid and diol, possesses a number-average molecular weight in the range of 2,000 to 15,000 and an acid value of 5 or less, and has the terminal groups thereof formed substantially wholly of hydroxyl groups. The aforesaid resin has a glass transition temperature of 40°~80° C. and an acid value of 5 or less. Examples of suitable resins are the aforementioned resins modified by graft copolymerization, block copolymerization or like processes of acrylics, aminoacrylic monomers and the like with linear polyesters, and having the same glass transition temperature, softening point and molecular weight characteristics as previously described.

Charge-Controlling Agent

Examples of useful positive charge-controlling agents are well known agents such as Nigrosine base azide EX (made by Orient Kagaku Kogyo K. K.), Oil Black (made by Chuo Gosei Kagaku K. K.) Quaternary Ammonium salt P-51 (Farben fabriken Bayer, Inc.), alkoxylated amin, alkyl amide and the like.

On the other hand, examples of useful negative charge-regulating agents are well known agents such as azo dyes of chromiume complex salt type of S-32, 33, 34, 35, 37, 38, 40 and 44 (made by Orient Kagaku Kogyo K. K.), AizenSpilon Black TRH and BHH (made by Hodogaya Kagaku K. K.), Kayasetto Black T-2 and 004 (made by Nippon Kagaku K. K.), dye of copper phthalocyanine series S-39 (made by Oriental Kagaku Kogyo K. K.) and the like.

The additive amount of the aforementioned charge-controlling agents may be suitably selected in accordance with the kind of toner, toner additives, kind of binder resin and the like, and depending on the toner developing process (monocomponent or two-component) used. For example, when the charge-controlling agent is added in inside the toner manufactured by a grinding process or suspension process or the like, the ratio of the charge-controlling agent is 0.1 to 20 pbw on the basis of 100 pbw of resin for toner composition, and is preferably 1 to 10 pbw. If the amount of charge-controlling agent is smaller than 0.1 part-by weight, the desired electrical charge amount is not obtained, whereas when the addition amount exceeds 20 pbw, the charge amount is unstable and reduces the fixing properties of the toner.

On the other hand, when the charge-controlling is adhered to the toner surface, the ratio of the charge-controlling agent is 0.001 to 10 pbw on the basis of 100 pbw of toner particles, preferably 0.05 to 2 pbw, and ideally 0.1 to 1 pbw. When the amount of charge-controlling agent used is less than 0.001 pbw, the charge amount is inadequate because very little charge-regulating agent is present on the surface layer of the toner particles, and when the charge-controlling agent amount exceeds 10 pbw, the adherence of the charge-controlling agent to the surface of the toner particles is insufficient such that said charge-controlling agent is released from the surface of the toner particles during use.

Examples of useful coloring agents combinable with the toner for electrostatic image developing of the present invention are all well known pigments and dyes used in conventional developing toners.

The aforesaid coloring agents may be used singly or in combination, normally at a ratio of 1 to 20 pbw on the basis of 100 pbw of binder resin, and preferably 1 to 20 pbw. When the amount of coloring material exceeds 20 pbw, toner adhesion is reduced, whereas when the amount is less than 1 pbw, the desired image density cannot be obtained.

All well known pigments and dyes used in conventional translucent color toners are usable as coloring materials when the toner of the present invention is a translucent color toner. For example, yellow pigments such as C.I.10316 (naphthol yellow S), C.I.11710 (Hansa yellow 10G), C.I.12720 (pigment yellow L) and the like.

Examples of useful red pigments are C.I.12055 (Sterling I), C.I.12075 (permanent orange), C.I.12175 (lithol fast orange 3GL) and the like.

Examples of useful blue pigments are C.I.74100 (metal-free phthalocyanine blue), C.I.74160 (phthalocyanine blue), C.I.74180 (fast sky blue) and the like.

The aforesaid coloring materials may be used singly or two or more types in combination. The amount of coloring material used is 1 to 10 pbw on the basis of 100 pbw binder resin contained in the toner particles, and preferably 2 to 5 pbw. When the amount of coloring material exceeds 10 pbw, toner adhesion and translucence are reduced, whereas when the amount of coloring material is less than 1 pbw, the desired image density cannot be obtained.

Fluidizing Agent

In addition to the previously described magnetic fine particles, a common fluidizing agent may be added to the developing material of the present invention to improve fluidity. Examples of useful fluidizing agents are inorganic fine particles such as silica, aluminum oxide, titanium oxide, magnesium fluoride, and the like, as well as organic fine particles as hereinafter described used singly or in combination.

The organic fine particles usable in the present invention may be various types of organic fine particles such as styrene, (meth)acrylic, benzoguanamine, melamine, teflon, silicone, polyethylene, polypropylene and the like, granulated by wet polymerization methods such as emulsion polymerization, soap-free emulsion polymerization, non-aqueous dispersion polymerization, as well as vapor-phase process and the like. The cleaning characteristics may be improved by adding the aforesaid organic fine particles.

Fluidizing agent is added in an amount of 0.05 to 1.0 pbw on the basis of the toner in this invention.

Other Additives

Offset inhibitors may be used together with the toner of the present invention to improve fixing characteristics. Examples of preferable offset inhibiting materials are various waxes, particularly low molecular weight polypropylene and polyethylene, or polyolefin waxes such as polypropylene oxide, polyethylene oxide and the like. The aforesaid waxes preferably have a number-average molecular weight (Mn) of 1,000 to 20,000, and a softening point (Tm) of 80° to 150° C. When the number-average molecular weight is less than 1,000, or the softening point is under 80° C., the wax does not uniformly disperse in the binder resin of the toner, such that only the wax is removed at the toner surface and resulting not only in unsatisfactory toner storage and developing but also producing filming and like soiling of the photosensitive member. Furthermore, when the number-average molecular weight Mn of said wax exceeds 20,000 or the softening point Tm exceeds 150° C., compatibility with the binder resin not only deteriorates but the expected high-temperature offset resistance and the like are not obtained. From the perspective of compatibility when used in combination with polar group binder resins, polar group waxes are preferable.

Carrier

When the toner of the present invention is used as a two-component developing material, the carrier may be a well known iron, ferrite and like carriers. Furthermore, coated carriers may be used wherein a core material of iron and ferrite is covered by a ceramic layer of any of various synthetic resins. Coatings formed by dispersing or dissolving various organic and inorganic materials may be used to improve charging characteristics and various other properties of the developing material, and said materials may be fixed to the surface of the coated carrier.

Binder type carriers may also be used. That is, the aforesaid magnetic materials having coating layers of the various synthetic resins may be used as binder resins, and various organic and inorganic materials may be added, mixed, kneaded and ground to regulate the desired particle diameter. Although commonly used carriers have mean particle diameters of 20 to 200 μm, said particle diameter may be suitably adjusted in accordance with the developing method used.

The specific examples described below are based on the embodiments of the present invention.

| Production of carrier | |
|---|---|
| Constituents | parts by weight |
| Polyester resin (Kao K.K., NE-1110) | 100 |
| Magnetic powder (Toda Kogyo, EPT-1000) | 500 |
| Carbon black (Mitsubishi Kasei, MA#8) | 2 |

The aforesaid material was adequately mixed and ground in a Henschel mixer. then melted and kneaded by the use of an extrusion kneader having a cylinder part kept at 180° C. and a cylinder part kept at 170° C. The resultant blend was left cooling, the ground coarsely by the use of a feather mill, further pulverized finely with a jet mill, and classified with a classifier to obtain carrier particles having a mean particle diameter of 55 μm.

EXAMPLE 1

Five parts-by-weight carbon black (made by MA#8, Mitsubishi Kasei K. K.) and 5 pbw Supiron Black TRH (made by Hodogaya Kagaku Kogyo K. K.) were mixed and kneaded with 10 pbw styrene-acrylic copolymer resin (made by softening point: 120° C., glass transition point: 60° C.), then ground and classified to obtain the 8 μm toner A.

One part-by-weight ferrite fine particles (nickel zinc ferrite having a mean particle diameter of 15 nm was subjected to a hydrophobic process with dimethyldichlorosilane to achieve 40% hydrophobicity, electrical resistance of $6.3\times10^{33}$ Ωcm, and length-to-breadth diameter ratio of 0.9) were added to 100 pbw of the toner A, and mixed and stirred in a Henschel Mixer at 1,600 rpm for 2 minutes. Finally, the carrier produced as described in the carrier production example was added at a weight ratio (toner/carrier) of 7/93, mixed, then evaluated.

EXAMPLE 2

Developing material was produced in the same manner as described in Example 1, with the exception of the hydrophobic process of the ferrite fine particles which is described below. The developing material was then evaluated.

[Ferrite Fine Particle Hydrophobic Process]

3,3,4,4,5,5,6,6,7,7,8,8,10,10,10-heptadecafluorodecyltrimethoxysilane at 1.5 g, 0.15 g of γ-aminopropyltriethoxysilane, and 0.5 g of hexamethyldisilazane were brought into solution by 10 g of tetrahydrofuran to form a solution. Fifty grams of the ferrite fine particles of Example 1 poured into a high-speed mixer, and the aforementioned mixed solution was gradually added thereto meanwhile over a period of about 5 minutes. The material was then mixed at high speed for 10 minutes, heated at 150° C. in a thermostatic chamber, then ground to obtain hydrophobic ferrite fine particles (degree of hydrophobicity: 52%).

EXAMPLE 3

One hundred parts-by-weight of the toner A produced in Example 1, 0.5 pbw of magnetite fine particles (magnetite fine particles FB-1 (Okamura Seiyu K. K.), particle diameter: 10~50 nm, were subjected to hydrophobic process with octyltrimethoxysilane to produce a hydrophobicity of 54%, an electrical resistance of $7.3\times10^{10}$ Ωcm, and a length/breadth diameter ratio of 0.8), and 0.1 pbw hydrophobic silica (made by Nippon Airojiru K. K., R-972) were mixed in a Henschel Mixer at a speed of 1,600 rpm for 2 minutes to produce the toner A'. The aforesaid toner A' was mixed with the carrier of the carrier production example at a weight ratio of 7/93, and the resulting developing material was evaluated.

EXAMPLE 4

A toner with constituents identical to the toner A produced in Example 1 was made, but the grinding and classification conditions were modified to produce a toner C having a mean particle diameter of 6 μm. Ferrite fine particles and hydrophobic silica were processed in the same manner as Example 1, with the exception that 0.1 pbw hydrophobic silica (R-972) was added as a post-processing agent to 100 pbw toner C. The obtained toner was mixed with the carrier of the carrier production example at a weight ratio (toner/carrier) of 7/93, and the resulting developing material was evaluated.

COMPARATIVE EXAMPLE 1

A developing material was produced in the same manner as in Example 1, with the exception that colloidal silica R-972 (made by Nippon Airojiru K. K.) was used instead of the ferrite fine particles. The obtained developing material was evaluated.

COMPARATIVE EXAMPLE 2

A developing material was produced in the same manner as in Example 1, with the exception that the ferrite fine particles used had a mean particle diameter of 200 nm. The obtained developing material was evaluated.

COMPARATIVE EXAMPLE 3

The developing material was produced in the same manner as in Example 3, with the exception that magnetite fine particles untreated by a hydrophobic process were used. The material was evaluated.

Evaluation Of Physical Properties (1) Toner particle diameter

Toner particle diameter was measured using a laser scattering type particle size distribution measuring device SALD-1100 (Shimadzu Seisakusho). The mean particle size and size distribution were determined.

(2) Carrier particle diameter

Carrier particle diameter was measured using a Microtrack model 7995-10SRA (Nikisei K. K.). The mean particle diameter was determined.

(3) Charging amount (Q/M) and scattering

Two grams of the toners prepared in the examples and comparative examples and 28 g of the previously described carrier were poured into a polyethylene bottle (50 cc capacity) and placed in a rotating frame which was then rotated at 1,200 rpm for 5 min, 10 min, and 20 min, then changes in the amount of toner charge and the mixed state were checked. After mixing for 20 min, the amount of scattering was also measured. After the developing material was exposed for 24 hr at 35° C. and 85% humidity, the charge amount of toner and toner scattering amount were again measured.

The amount of scattering was measured using a digital particulate measuring device model P5H2 (Shibata Kagaku K. K.). A magnet roller was installed 10 cm removed from the aforesaid measuring device. Two grams of the developing material was set on top of the magnet roller, and while the magnet roller was rotated at a speed of 2,000 rpm the toner particle dust was measured by the device which displayed the count value after 1 min (cpm). The amount of scattering thus produced was evaluated in three levels, such that 300 cpm or less was ranked O, 500 cpm or less was ranked Δ, and more than 500 cpm was ranked X. The Δ rank was deemed suitable for practical application, whereas the O rank was preferable. The results of the measurements of the amount of charge and amount of scattering are shown in Table 1.

TABLE 1

| | 5 min mixing | | 10 min mixing | | 20 min mixing | | | Humidity resistance value | |
|---|---|---|---|---|---|---|---|---|---|
| | Charge μC/g | Mix state | Charge μC/g | Mix state | Charge μC/g | Scatter cpm | Mix state | Charge μC/g | Scatter cpm |
| Ex. 1 | −13 | good | −14 | good | −14 | Δ | good | −11 | Δ |
| Ex. 2 | −14 | good | −15 | good | −16 | ○ | good | −15 | ○ |
| Ex. 3 | −14 | good | −15 | good | −15 | ○ | good | −14 | ○ |
| Ex. 4 | −18 | good | −17 | good | −17 | ○ | good | −16 | ○ |
| Comp. 1 | −13 | good | −15 | good | −16 | X | good | −12 | X |
| Comp. 2 | −3 | *1 | −7 | *2 | −9 | X | *3 | −6 | X |
| Comp. 3 | −11 | good | −12 | good | −12 | Δ | good | −9 | X |

*1: Flow characteristics deteriorate, toner remains massed and does not mix with the carrier.
*2: Toner masses are relatively smaller, but remain unchanged.
*3: Toner masses are nearly absent, but toner is not uniformly dispersed in the carrier.

What is claimed is:

1. A developer for developing electrostatic latent images obtained by mixing toner particles which comprises a binder resin and a coloring agent with fine magnetic particles treated by a hydrophobic agent and having a mean particle size of 100 nm or less.

2. The developer of claim 1, wherein the magnetic fine particles have an electrical resistance of $10^6\Omega\cdot$cm or more.

3. The developer of claim 1, wherein the magnetic fine particles have a degree of hydrophobicity of 30% or more.

4. The developer of claim 1, wherein the magnetic fine particles are treated by a coupling agent.

5. The developer of claim 1, wherein the amount of the magnetic fine particles is 0.05 to 30 parts-by-weight on the basis of the toner.

6. The developer of claim 1, wherein the magnetic fine particles have a smallest diameter/largest diameter ratio of 0.7 or more.

7. A developer for developing electrostatic latent images obtained by mixing toner particles which comprises a binder resin and a coloring agent, with a fluidizing agent and fine magnetic particles treated by a hydrophobic agent and having a mean particle size of 100 nm or less.

8. The developer of claim 1, wherein the binder resin has a relationship between the number average molecular weight (Mn), weight average molecular weight (Mw) and Z average molecular weight (Mz) as shown below:

$$1{,}000 \leqq Mn \leqq 7{,}000$$

$$40 \leqq Mw/Mn \leqq 70$$

$$2{,}000 \leqq Mz/Mn \leqq 7{,}000.$$

9. The developer of claim 7, wherein the magnetic fine particles have a degree of hydrophobicity of 30% or more.

10. The developer of claim 7, wherein the amount of the magnetic fine particles is 0.05 to 30 parts-by-weight on the basis of the toner.

11. The developer of claim 7, wherein the amount of the fluidizing agents is 0.05 to 1.0 part-by-weight on the basis of the toner.

12. The developer of claim 11, wherein the fluidizing agents are treated by a hydrophobic agent.

13. The developer of claim 4, wherein the coupling agent comprises a long chain alkyl group.

* * * * *